US005315059A

United States Patent [19]

Saito

[11] Patent Number: 5,315,059

[45] Date of Patent: May 24, 1994

[54] CHANNEL ASSIGNING SYSTEM FOR ELECTRONIC MUSICAL INSTRUMENT

[75] Inventor: Tsutomu Saito, Iwata, Japan

[73] Assignee: Kawai Musical Inst. Manufacturing Co., Ltd., Shijouka, Japan

[21] Appl. No.: 22,383

[22] Filed: Feb. 24, 1993

Related U.S. Application Data

[63] Continuation of Ser. No. 813,824, Dec. 27, 1991, abandoned.

[30] Foreign Application Priority Data

Dec. 28, 1990 [JP] Japan ..... 2-409578

[51] Int. Cl.[5] ..... G10H 1/057; G10H 1/06; G10H 1/22; G10H 1/46

[52] U.S. Cl. ..... 84/656; 84/658; 84/659; 84/663; 84/665; 84/DIG. 2

[58] Field of Search ..... 84/618, 622-627, 84/633, 656, 658-661, 663, 665, 684, 687-690, 702, 703, 711, DIG. 2

[56] References Cited

U.S. PATENT DOCUMENTS 5,095,800 3/1992 Matsuda ..... 84/618

*Primary Examiner*—Stanley J. Witkowski

[57] ABSTRACT

A preferential order of channel vacating is determined according to a musical character of musical tones having assigned channels, thus permitting a channel assignment which does not depart from the harmony of the musical tone. The greater the number of tones which are equivalent in musical character, the more readily channels can be vacated for new tones, and tones with fewer equivalent tones in musical character may remain assigned. The channel selection may also be limited for low envelope level tones.

29 Claims, 15 Drawing Sheets

FIG. 4

ASSIGNMENT MEMORY

10

| ADDRESS | | | |
|---|---|---|---|
| 00 | ON/OFF | KEY NUMBER KN | CH0 |
| 01 | SOUND GROUP NO. GN、DEVICE NO. DN | | |
| 02 | INITIALTOUCH IT | | |
| 03 | TONE NUMBER TN | | |
| 04 | ON/OFF | KEY NUMBER KN | CH1 |
| 05 | SOUND GROUP NO. GN、DEVICE NO. DN | | |
| 06 | INITIALTOUCH IT | | |
| 07 | TONE NUMBER TN | | |
| 08 | ON/OFF | KEY NUMBER KN | CH2 |
| 09 | SOUND GROUP NO. GN、DEVICE NO. DN | | |
| 0A | INITIALTOUCH IT | | |
| 0B | TONE NUMBER TN | | |
| 0C | ON/OFF | KEY NUMBER KN | CH3 |
| 0D | SOUND GROUP NO. GN、DEVICE NO. DN | | |
| 0E | INITIALTOUCH IT | | |
| 0F | TONE NUMBER TN | | |
| | ⋮ | | |
| 3C | ON/OFF | KEY NUMBER KN | CH15 |
| 3D | SOUND GROUP NO. GN、DEVICE NO. DN | | |
| 3E | INITIALTOUCH IT | | |
| 3F | TONE NUMBER TN | | |

FIG. 5

WORKING MEMORY 25

TONE NO. REGISTERS

| | | |
|---|---|---|
| UPPER GN=00 | TONE NO. TN | 26a |
| UPPER GN=01 | TONE NO. TN | 26b |
| LOWER GN=10 | TONE NO. TN | 26c |
| PEDAL GN=20 | TONE NO. TN | 26d |
| RYTHM GN=30 | TONE NO. TN | 26e |
| RYTHM GN=31 | TONE NO. TN | 26f |
| RYTHM GN=32 | TONE NO. TN | 26g |
| RYTHM GN=34 | TONE NO. TN | 26h |

VOLUME REGISTERS

| | | |
|---|---|---|
| UPPER GN=00 | VOLUME VOL | 28a |
| UPPER GN=01 | VOLUME VOL | 28b |
| LOWER GN=10 | VOLUME VOL | 28c |
| PEDAL GN=20 | VOLUME VOL | 28d |
| RYTHM GN=30 | VOLUME VOL | 28e |
| RYTHM GN=31 | VOLUME VOL | 28f |
| RYTHM GN=32 | VOLUME VOL | 28g |
| RYTHM GN=34 | VOLUME VOL | 28h |

OCCUPIED CHANNEL NO. REGISTERS

| | | |
|---|---|---|
| UPPER GN=0* | OCCUPIED CHANNEL NO. UC | 27a |
| LOWER GN=1* | OCCUPIED CHANNEL NO. UC | 27b |
| PEDAL GN=2* | OCCUPIED CHANNEL NO. UC | 27c |
| RYTHM GN=3* | OCCUPIED CHANNEL NO. UC | 27d |

FIG. 6

ENVELOPE DESIGNATION DATA MEMORY

| ADDRESS | 31 | |
|---|---|---|
| 00 | U/D SPEED SPD(ATT) | CH0 |
| 01 | TARGET PEP(ATT) | |
| 02 | U/D SPEED SPD(DEC) | |
| 03 | TARGET PEP(DEC) | |
| 04 | U/D SPEED SPD(REL) | |
| 05 | TARGET PEP(REL) | |
| 06 | LOUD, wp, PN | |
| 07 | — — | |
| | ⋮ | |
| 78 | U/D SPEED SPD(ATT) | CH15 |
| 79 | TARGET PEP(ATT) | |
| 7A | U/D SPEED SPD(DEC) | |
| 7B | TARGET PEP(DEC) | |
| 7C | U/D SPEED SPD(REL) | |
| 7D | TARGET PEP(REL) | |
| 7E | LOUD, wp, PN | |
| 7F | ——— | |

ENVELOPE LEVEL MEMORY

| ADDRESS | 32 | |
|---|---|---|
| 80 | ENVELOPE LEVEL EL | CH0 |
| 81 | ENVELOPE LEVEL EL | CH1 |
| 82 | ENVELOPE LEVEL EL | CH2 |
| 83 | ENVELOPE LEVEL EL | CH3 |
| 84 | ENVELOPE LEVEL EL | CH4 |
| 85 | ENVELOPE LEVEL EL | CH5 |
| 86 | ENVELOPE LEVEL EL | CH6 |
| 87 | ENVELOPE LEVEL EL | CH7 |
| 88 | ENVELOPE LEVEL EL | CH8 |
| 89 | ENVELOPE LEVEL EL | CH9 |
| 8A | ENVELOPE LEVEL EL | CH10 |
| 8B | ENVELOPE LEVEL EL | CH11 |
| 8C | ENVELOPE LEVEL EL | CH12 |
| 8D | ENVELOPE LEVEL EL | CH13 |
| 8E | ENVELOPE LEVEL EL | CH14 |
| 8F | ENVELOPE LEVEL EL | CH15 |

LOUD : LOUDNESS
wp : WRITE PROTECT
PN : PHASE NUMBER

MODIFIED ENVELOPE LEVEL MEMORY

| ADDRESS | 33 | |
|---|---|---|
| 90 | MODIFIED ENVELOPE LEVEL MEL | CH0 |
| 91 | MODIFIED ENVELOPE LEVEL MEL | CH1 |
| 92 | MODIFIED ENVELOPE LEVEL MEL | CH2 |
| 93 | MODIFIED ENVELOPE LEVEL MEL | CH3 |
| 94 | MODIFIED ENVELOPE LEVEL MEL | CH4 |
| 95 | MODIFIED ENVELOPE LEVEL MEL | CH5 |
| 96 | MODIFIED ENVELOPE LEVEL MEL | CH6 |
| 97 | MODIFIED ENVELOPE LEVEL MEL | CH7 |
| 98 | MODIFIED ENVELOPE LEVEL MEL | CH8 |
| 99 | MODIFIED ENVELOPE LEVEL MEL | CH9 |
| 9A | MODIFIED ENVELOPE LEVEL MEL | CH10 |
| 9B | MODIFIED ENVELOPE LEVEL MEL | CH11 |
| 9C | MODIFIED ENVELOPE LEVEL MEL | CH12 |
| 9D | MODIFIED ENVELOPE LEVEL MEL | CH13 |
| 9E | MODIFIED ENVELOPE LEVEL MEL | CH14 |
| 9F | MODIFIED ENVELOPE LEVEL MEL | CH15 |
| A0 | FIRST MINUM LEVEL CH. NO. | |
| A1 | SECOND MINUM LEVEL CH. NO. | |
| A2 | THIRD MINUM LEVEL CH. NO. | |

FIG. 7

WEIGHT FACTOR DATA TABLE 20

| OCCUPIED CH.NO. UC | UPPER | LOWER | PEDAL | RYTHM |
|---|---|---|---|---|
| 01 | ○ 1.00 | ○ 0.95 | ○ 0.98 | ○ 0.97 |
| 02 | ○ 1.00 | ○ 0.95 | 0.30 | ○ 0.97 |
| 03 | ○ 1.00 | ○ 0.95 | 0.20 | ○ 0.95 |
| 04 | ○ 1.00 | ○ 0.90 | 0.10 | ○ 0.92 |
| 05 | ○ 0.94 | 0.83 | 0.10 | ○ 0.90 |
| 06 | ○ 0.90 | 0.81 | 0.10 | 0.85 |
| 07 | 0.85 | 0.70 | 0.10 | 0.80 |
| 08 | 0.80 | 0.60 | 0.10 | 0.80 |
| 09 | 0.75 | 0.50 | 0.10 | 0.75 |
| 10 | 0.70 | 0.40 | 0.10 | 0.75 |
| 11 | 0.65 | 0.30 | 0.10 | 0.65 |
| 12 | 0.60 | 0.30 | 0.10 | 0.55 |
| 13 | 0.55 | 0.30 | 0.10 | 0.45 |
| 14 | 0.50 | 0.30 | 0.10 | 0.35 |
| 15 | 0.45 | 0.30 | 0.10 | 0.25 |
| 16 | 0.40 | 0.30 | 0.10 | 0.15 |

FIG. 8

WEIGHT FACTOR DATA TABLE

20

| OCCUPIED CH. NO. OF SAME KEY NUMBER KN SAME SOUND GROUP GN | WEIGHT FACTOR WP |
|---|---|
| 01 | 1.00 |
| 02 | 0.70 |
| 03 | 0.60 |
| 04 | 0.50 |
| 05 | 0.40 |
| 06 | 0.30 |
| 07 | 0.20 |
| 08 | 0.10 |
| 09 | 0.10 |
| 10 | 0.10 |
| 11 | 0.10 |
| 12 | 0.10 |
| 13 | 0.10 |
| 14 | 0.10 |
| 15 | 0.10 |
| 16 | 0.10 |

CHANNEL ASSIGNING SYSTEM FOR ELECTRONIC MUSICAL INSTRUMENT

This application is a continuation, of application Ser. No. 07/813,824 filed on Dec. 27, 1991, now abandoned.

BACKGROUND OF THE INVENTION

1. Field of the Invention

This invention relates to a channel assigning system for an electronic musical instrument and more particularly, to an improved method of determining the channel assignment priority order.

2. Description of the Related Art

In a prior art channel assigning system, when, for example, a Key On event occurs in a keyboard of a electronic musical instrument, a check is made to determine whether a musical tone corresponding to a "key off" event exists among tones having respective channels assigned thereto. If a tone corresponding to a "key off" event does exists, a channel assigned to the tone corresponding to the new "key off" event is a channel that was assigned to the tone corresponding to the "key off" event.

In an improved channel assigning system, sequential "key on" and "key off" event order numbers of tones having respective channels assigned thereto are stored, and the channels are assigned in accordance with the sequential order numbers.

When a plurality of tones are produced simultaneously, some are very easily heard by the human ear when muted, but others are not. For example, when a plurality of low pitch tones are produced together with a high pitch tone, if the "key off" of the low pitch tone occurs earlier than the "key off" of the high pitch tones, usually the channel corresponding to the earlier "key off" high pitch tone will be assigned to a tone corresponding to a new "key off" event. However, if the sounding level the high pitch tone is not very different from the low pitch tones, the "key off" of the former is more easily heard by the human ear than the "key off" of the low pitch tones, and acoustically this produces a feeling of discomfort. This is true not only for the tone pitch but also for the timbre, speed and strength of a sounding operation, and the performance of a melody, chord and rhythm.

SUMMARY OF THE INVENTION

The present invention is intended to solve the above problem, and an object thereof is to provide a channel assigning system for an electronic musical instrument, by which a channel assignment not providing an acoustic discomfort is obtained according to content of tones sounded.

Therefore, according to the present invention, there is provided a channel assigning system for an electronic musical instrument, which system comprises a number of musical tone generation channels corresponding to a maximum number of musical tones capable of being sounded simultaneously, a channel assigning means for assigning the musical tone generation channels to input musical tones, musical character detecting means for detecting a musical character of the musical tones which is assigned to said musical tone generation channels by said channel assigning means, weight factor data generating means for generating weight factor data indicating a preferential degree of channel assignment for each musical tone, according to the musical character of the musical tones detected by said musical character detecting means, and channel assignment control means for selecting a channel according to the weight factor data generated by said weight factor data generating means and assigning a newly input musical tone to said selected channel.

BRIEF DESCRIPTION OF THE DRAWINGS

FIG. 4 is a view showing an assignment memory 10;

FIG. 5 is a view showing a working memory 25;

FIG. 6 is a view showing an envelope designation data memory 31, an envelope level memory 32, and a modified envelope level memory 33;

FIG. 7 is a view showing a weight factor data table 20;

FIG. 8 is a view showing a difference example of a weight factor data table 20;

DESCRIPTION OF THE PREFERRED EMBODIMENTS

In the illustrated embodiment of the invention, three channels for low envelope level tones are selected by minimum level detection circuits 41 to 43, and among these channels, the channel for which a weight factor data WP is at a minimum is vacated to a new tone (Steps 39, 34). As shown in FIGS. 7 and 8, the smaller the weight factor data WP, the more channels can be assigned to tones which are equivalent in the musical character, and the more channels can be readily vacated for new tones.

1. Overall circuit

Figure 2:
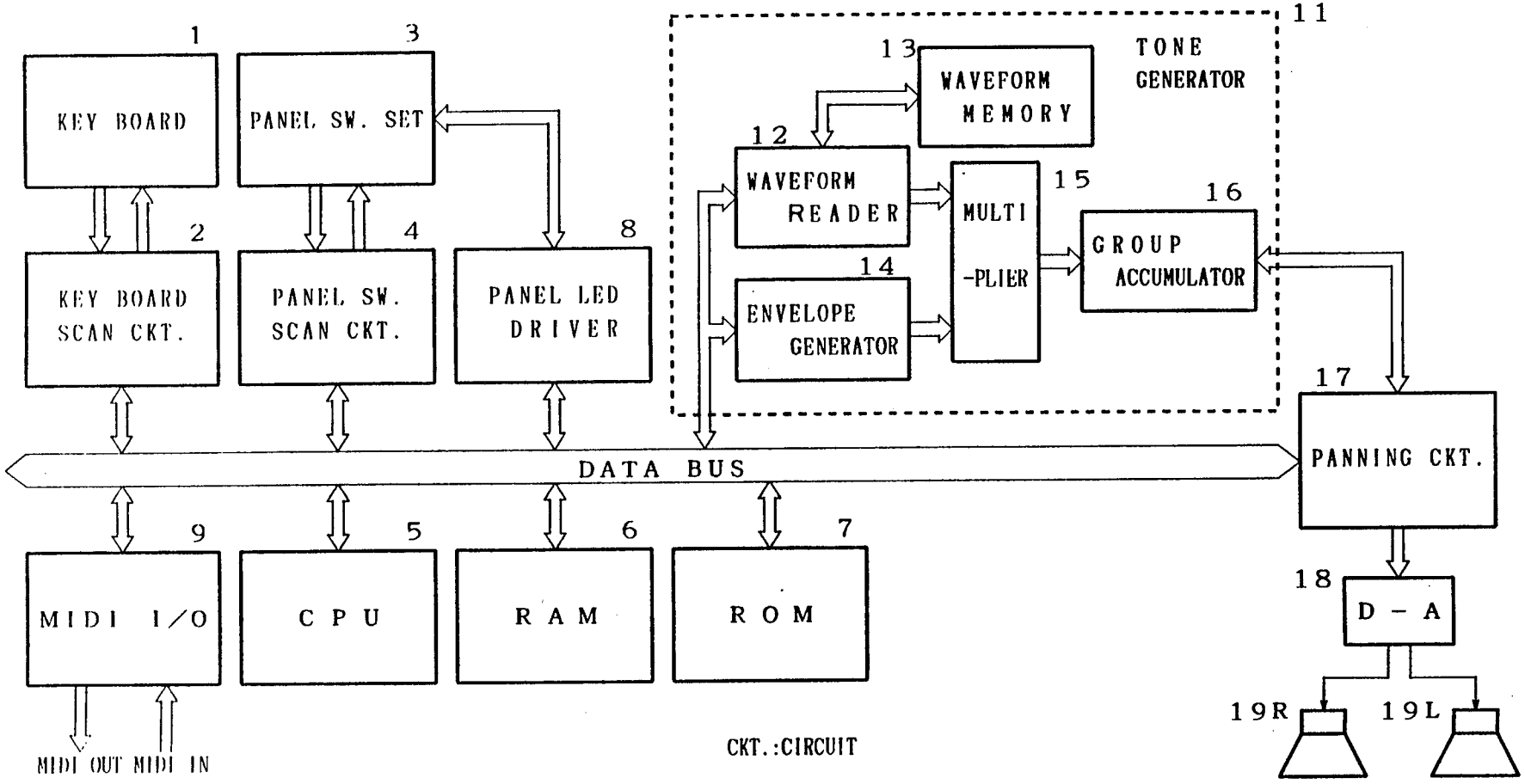
FIG. 2 is a block diagram showing a circuit of the overall electronic musical instrument.

FIG. 2 shows the overall circuit of the electronic musical instrument. Individual keys on a keyboard 1 are used for designating the sounding of respective tones, and are scanned by a keyboard scanner 2 to detect "key on" and "key off" data, which data is written to a RAM 6 by a CPU 5. This data is compared with "key on" and "key off" data stored in the RAM 6, and the occurrence of "key on" and "key off" events is then determined by the CPU 5.

The keyboard 1 comprises a lower keyboard, an upper keyboard, and a pedal keyboard, to thereby permit the sounding of tones having different tone colors, i.e., having different envelope waveforms. The upper keyboard permits a simultaneous sounding of two different color tones with a single "key on". The keyboard 1 may be replaced by an electronic string instrument, a wind (reed) instrument, a percussion (pad) instrument, or a computer keyboard, etc.

The switches of a panel switch set 3 are scanned by a panel switch scanning circuit 4, to detect "switch on" and "switch off" data, which data is written to the RAM 6 by the CPU 5. This data is compared with "switch on" and "switch off" data stored in the RAM 6, and the occurrence of "switch on" and "switch off" events is determined by the CPU 5. The "switch on" and "switch off" data is supplied to a panel LED driver 8, to turn on and off the LEDs provided for the respective switches.

A MIDI interface 9 sends and receives tone data to and from externally connected electronic musical instruments. The tone data meets MIDI (musical instrument digital interface) standards, and a sounding can be effected according to this data. Various process data are stored in the RAM 6, in addition to the above data, and accordingly, the RAM 6 includes an assignment memory 10 in which are stored tone data of tones to which channels of a 16-channel tone generation system are assigned respectively, and a working memory 25.

Programs, sequence data and envelope designation data for various processes executed by the CPU 5 are stored in a ROM 7. Some of these processes will be described later with reference to flow charts. The sequence data is used for an automatic playing of the electronic musical instrument, and consist of a group of tone data to be sounded. The envelope designation data includes speed data SPD and target data PEP for envelope waveforms corresponding to tone colors or key touches. The ROM 7 further includes a weight factor data table 20, as described later. The waveform data stored in the waveform memory 13 may be stored in the ROM 7.

A tone generator 11 generates tones corresponding to the pitch of "on" keys on the keyboard 1, the touches of "key on" and "key off" events, and tone colors corresponding to "on" switches on the panel switch set 3, and so forth. The term "touch" denotes data indicating the speed or strength of a sounding operation of keys of the keyboard 1. The tone generator 11 is provided with a tone generation system for a plurality of, for example, 16, time division channels for polyphonically sounding tones. Tone signals generated from the tone generator 11 are supplied to a panning circuit 17 for a level control of left and right stereo tone signals, then supplied to a D-A converter 18 to be converted to analog signals, and then are sounded from right and left loudspeakers 19R and 19L.

A waveform reader 12 in the tone generator 11 reads out tone waveform data by a time-sharing reading from a waveform memory 13, at speeds corresponding to the designated pitches, and an envelope generator 14 in the tone generator 11 generates a plurality of envelope waveform data on a time-sharing basis. The tone waveform data and envelope waveform data are multiplied by a multiplier 15 and accumulated in a group accumulator 16 for each tone data sound group, and thereafter are supplied to the panning circuit 17.

2. Panel switch set 3

Figure 3:
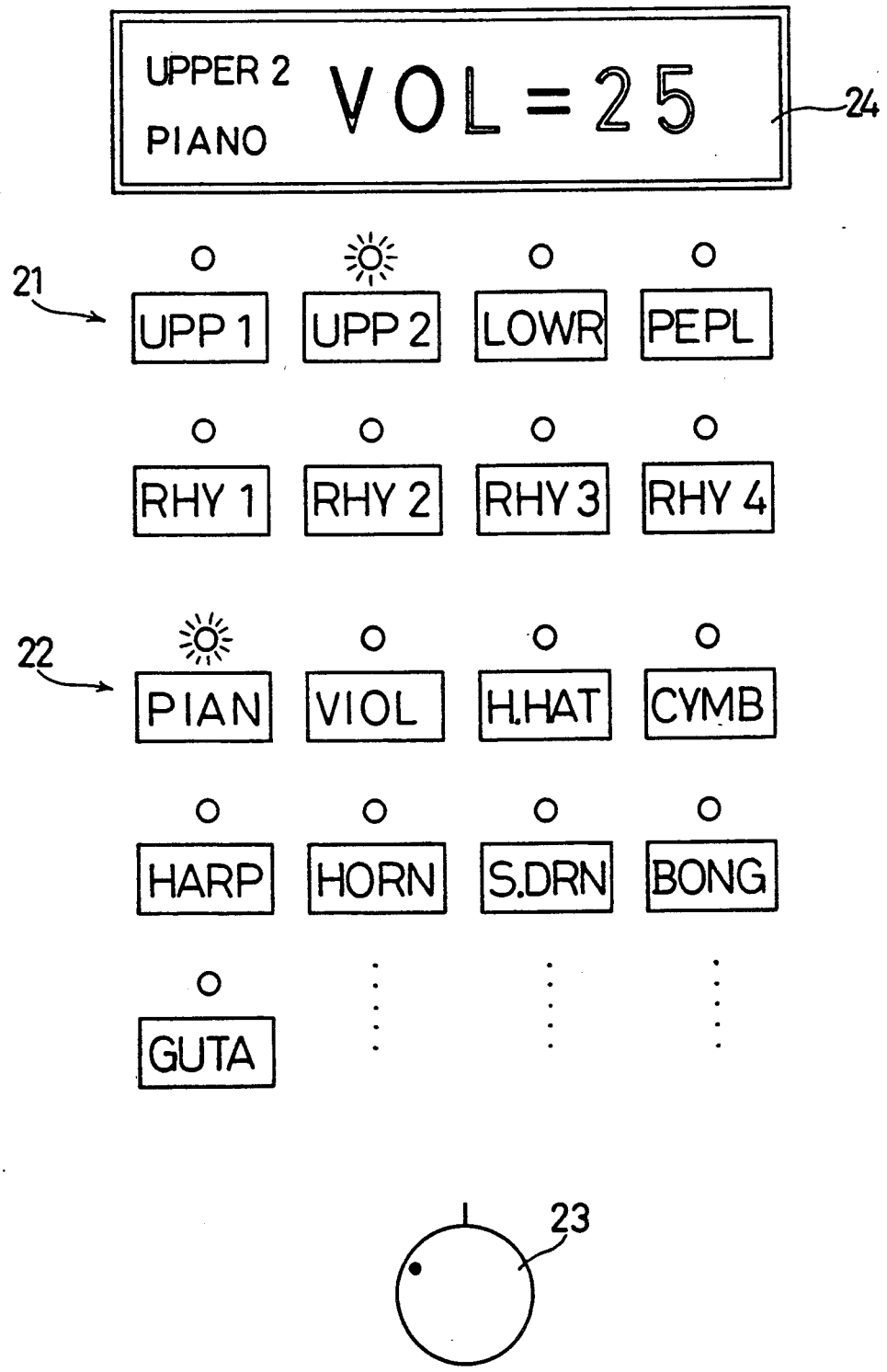
FIG. 3 is a view showing a panel switch group 3.

FIG. 3 shows part of the panel switch set 3 including a sound group switches 21 and tone color switches 22. The sound group switches 21 include switches UPP1, UPP2, LOWER, PEDL, RHY1, RHY2, RHY3 and RHY4 for selecting sound group modes, whereby, a color or a volume data group can be set by selecting one of these modes. Two different tone colors can be set for the upper sound group, and thus a tone sounding with two different tone colors can be effected with a single "key on" event. Similarly, four different tone colors can be set for the rhythm sound group. The rhythm may be played manually, or automatically with a sequence device, as described later.

The tone color switches 22 include switches for selecting the tone colors of musical instruments such as piano, violin, and drums, etc. and each sound group tone color can be set with these tone color switches 22. A volume knob 23 is provided for setting a group of volume data for sounding tones. Namely, this volume knob 23 enables a volume data group to be set for each sound group.

3. Assignment memory 10

FIG. 4 shows an assignment memory 10 having memory areas for 16 channels. These memory areas store data of musical tones to which the 16 tone generation channels in the tone generator 11 are assigned. Each musical tone data stored in each channel memory area consists of on/off data, key number data KN, device number data DN, sound group number data GN, initial touch data IT, and tone number data TN.

The on/off data indicates an "on" ("1") or "off" ("0") state of each key of the keyboard 1, and the device number data DN indicates the sound source of data stored in the pertinent channel memory area. The sound source is either manual data from the keyboard (DN=0), MIDI data supplied from the MIDI interface 9 (DN=1) or sequence data (DN=2) read from the ROM 7. The device number data DN may be used as data indicating a melody, chord or rhythm performance.

The sound group number data GN sub-divides the manual data mentioned above and indicates upper (0), lower (1), base (2) and rhythm (3). The initial touch data IT indicates the speed of a "key on" or "key off" operation of each key of the keyboard 1; this data may be replaced by after-touch data indicating an operating pressure. The tone number data TN indicates the tone color of a piano, violin, and drums, etc.

4. Working memory 25

FIG. 5 shows the working memory 25 in the RAM 6. This working memory 25 is provided with tone number registers **26*a* to 26*h*, volume data group registers 27*a* to 27*h*, and occupied channel number registers 28*a* to 28*d***.

Tone number data TN representing the tone colors are set by the tone color switches 22 for the individual sound groups of UPPER 1, UPPER 2, LOWER, . . . by the panel switches 3. The tone number data TN are stored in the tone number registers **26*a* to 26*h*. Volume data group data VOL are set by the volume data group knob 23 for the individual sound groups of UPPER 1, UPPER 2, LOWER, . . . by the panel switches 3, and are stored in the volume data group registers 27*a* to 27*h***.

Occupied channel number data UC are set in the occupied channel number registers **28*a* to 28*d***, and the occupied channel number data UC represent the total numbers of assigned channels for the individual four sound groups of upper (UPPER 1 and UPPER 2), lower, pedal and rhythm (RHYTHM 1 to RHYTHM 4).

5. Memories 31 to 33 in envelope generator 14

FIG. 6 shows three memories 31 to 33 provided in the envelope generator 14, i.e., an envelope designation data memory 31, an envelope level memory 32, and a modified envelope level memory 33.

The envelope designation data memory 31 has 16 channel memory areas, and in each of these channel memory areas stores envelope designation data indicating the content of the envelope waveform of a tone to which the pertinent channel is assigned.

The envelope designation data consists of speed data SPD for the attack decay and release of the envelope waveform, target data TGD, loudness data LOUD, phase number data PN, and write protect data wp.

The speed data SPD indicates the speed or rate of a change in each phase of the envelope waveform. Up/-down data U/D is added as high-order data of the speed data SPD, and the phase change rate indicates either an increment or a decrement. The target data TGD indicates the level reached by each phase of the envelope waveform, and the envelope waveform is changed to reach the target data TGD at a rate corresponding to the speed data SPD. The sustain phase of the envelope waveform is held only until a "key off" event of the target data TGD of the decay phase, and no data is stored.

The loudness data LOUD indicates a volume group. This data is synthesis data combining the initial touch data IT indicating the speed of a sounding operation to the volume data group set for each sound group, with the volume knob 23 in the panel switch set 3. This synthesis is achieved by a multiplification or addition of one of the two data as high order data and the other as low order data. The phase number data PN indicates the attack, decay, sustain, and release phases of the envelope waveform. The write protect data wp is one-bit data permitting ("1") or inhibiting ("0") the updating of the phase number data PN.

The envelope level memory 32 also has channel memory areas for 16 channels, and each of these channel memory areas stores envelope data EL of a tone to which the pertinent channel is assigned. The envelope level data EL indicates the level of the envelope waveform of a tone being sounded at that moment.

The modified envelope level memory 33 also has channel memory areas for 16 channels, and each of these channel memory areas stores modified envelope level data MEL of a tone to which the pertinent channel is assigned. The modified envelope level data MEL is obtained by modifying the envelope level data EL, using the weight factor data WP. The modified envelope level memory 33 has three memory areas in which channel numbers for three tone data are stored, in the order of smallest data, to largest data as the modified envelope level data MEL.

6. Weight factor data table 20

FIG. 7 shows a weight factor data table 20 in the ROM 7. The weight factor data WP indicates the preferential degree of the channel assignment. The data WP can take values of "00.0" to "1.00", and the smaller the value, the more readily the corresponding channel can be assigned to tones for new "key on" events.

The weight factor data WP is set for each sound group, and the smaller the value of the occupied channel number data UC for each sound group, the more readily the corresponding channels can be assigned to tones for new "key on" events. Every time a channel is assigned to a new tone, all the weight factor data WP belonging to the same sound group as that of the new tone is rewritten as data corresponding to the new occupied channel number.

The weight factor data WP also indicates an ideal channel number for each sound group. If 16 channels are assigned by ignoring the envelope level data EL, four channels are assigned to upper sound group tones ("1.00"), a channel is assigned to a pedal sound group tone ("0.98"), two channels are assigned to rhythm sound group tones ("0.97"), three channels are assigned to lower sound group tones, a channel is assigned to a rhythm sound group tone ("0.95"), a channel is assigned to an upper sound group tone ("0.94"), a channel is assigned to a rhythm sound group tone ("0.92"), and three channels are assigned to upper, lower, and rhythm sound group tones ("0.90"). This ideal channel assignment are shown by circles in FIG. 7.

FIG. 8 shows a different example of the weight factor data table 20. In this example, the preferential degree of channel assignment is determined according to the number of channels assigned to tones of the same sound group and same key number as new tones. As the number of channels assigned to tones of the same sound group and same key number is increased from "1" to "16", the weight factor data WP is changed from "1.00" to "0.10". This permits a ready assignment of channels to tones having different pitches and different sound groups.

The weight factor data WP shown in FIGS. 7 and 8 is "1.00" when the occupied channel number data UP or number of channels assigned to tones of the same sound group and same key number is "0". It is possible to produce new weight factor data WP by a synthesis, such as a multiplification or addition, from the two weight factor data WP shown in FIGS. 7 and 8.

The smaller the value of the weight factor data WP shown in FIGS. 7 and 8, greater the number of tones which are equivalent in the musical character, which, facilitates the vacating of channels to new tones and permits the fewest of musical tones which are equivalent in musical character to remain. Accordingly, it is possible to vacate channels for tones without causing a substantial departure from a harmony thereafter and a leave many tones causing a departure from harmony when vacated. Namely, a channel assignment is obtained substantially free from an acoustic feeling of a departure from harmony can be obtained.

7. Envelope generator 14

Figure 1:
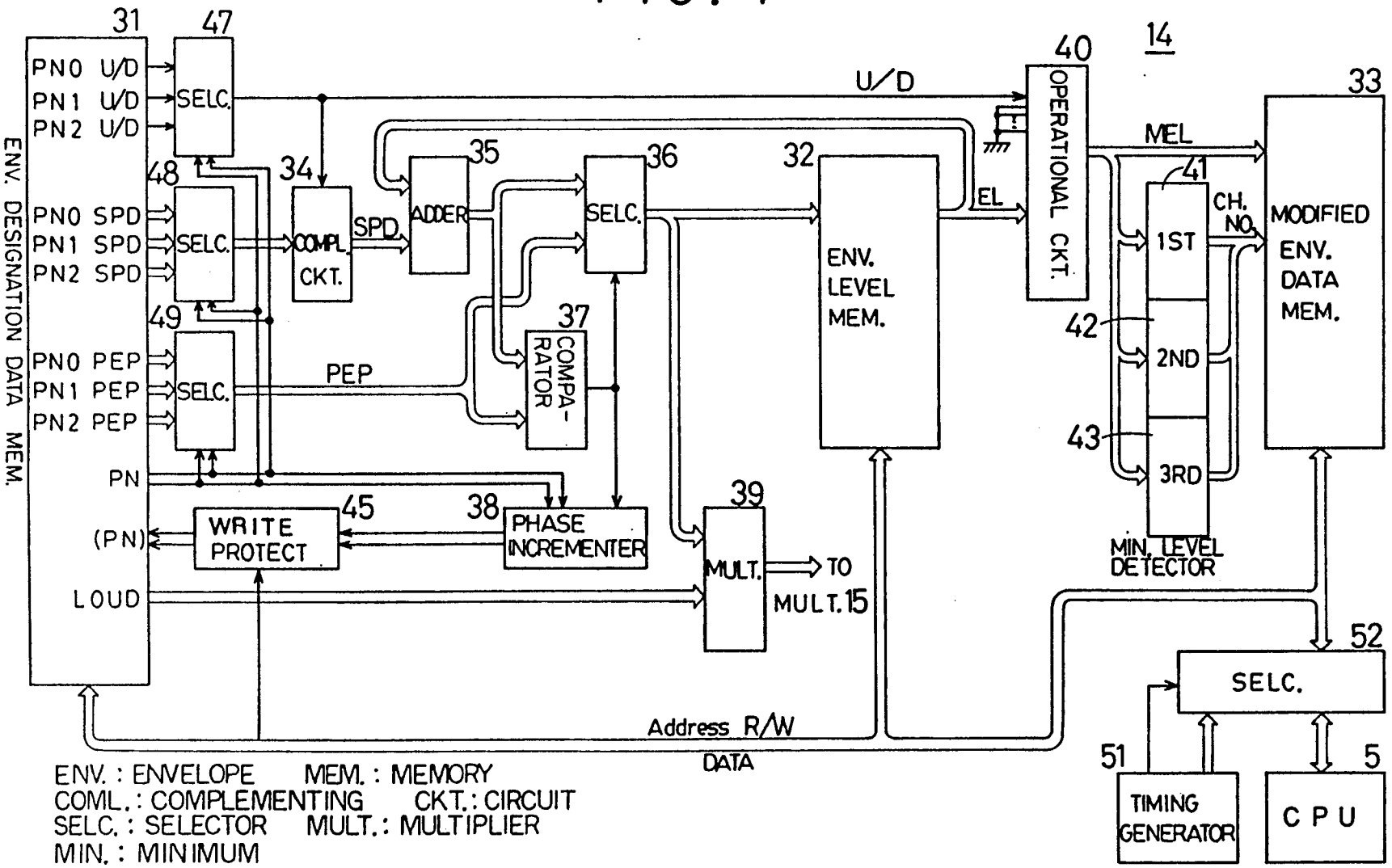
FIG. 1 is a block diagram showing an envelope generator 14.

FIG. 1 shows the envelope generator 14. The various data noted above in the envelope designation data memory 31 are read out from the ROM 7, processed, and written to the memory 31 by the CPU 5 according to data in the assignment memory 10. Data in the envelope designation data memory 31 are read out on a time-sharing basis, for each channel time.

Of the read-out data, speed data SPD of each envelope waveform phase is supplied via a selector 48 and a complimenting circuit 34 to an adder 35, for addition to or subtraction from the previous envelope level data.

The complimenting circuit 34 consists of, for example, exclusive OR gates. Each bit of the speed data SPD is sent to each gate, and the up/down data U/D as the MSB (most significant bit) of the speed data SPD is sent via a selector 47 to all of the gates. The speed data SPD is expressed as positive or negative data according to the up/down data U/D, and incremented by "+1" via the adder, whereby a complement value is output.

The envelope level data EL obtained as a result of an addition or subtraction of the speed data SPD is written in the envelope level memory 32. The write channel memory area is the same as the read channel memory area of the envelope designation data memory 31. The writing and reading are synchronized by a timing control circuit 51.

Further, envelope level data EL from the adder 35 and target data TGD of each envelope waveform phase read out from the envelope designation data memory 31 are sent via a selector 49 to a comparator 37. When the target data TGD is reached by the envelope level data EL through a successive addition or subtraction of the speed data SPD, a result signal is output to a selector 36. Upon receiving the result data, the selector 36 changes the select data from the envelope level data EL to the target data TGD.

The result signal is also input to a phase incrementor 38 constructed by, for example, a 2-bit input type adder, which adds the result signal ("+1") to the phase number data PN read out from the envelope designation data memory 31, to thus update the envelope waveform phase from attack to decay and sustain.

The resultant phase number data PN is written to the envelope designation data memory 31 via a write protect circuit 45. The write protect data wp is sent to the write protect circuit 45, whereby a write protect is provided when the phase number data PN is updated to "01(1)" (decay and sustain), and an erroneous updating to "10(2)" (release) is prevented. This is carried out because the updating from "01(1)" (decay and sustain) to "10(2)" (release) is effected at a "key off" event by the CPU 5 (Step 43 in FIG. 13).

The selectors 47 to 49 select either attack, decay or release data of the up/down, speed and target data U/D, SPD and TGD, respectively. The phase number data PN is set to the selectors 47 to 49 as select change data.

The speed data SPD, the target data TGD, the up/down data U/P, the phase data PN, and the loudness data LOUD noted above are read out collectively for each channel. If these data are read out in a plurality of groups, one after another, the read-out data may be stored in a latch for a synchronization with the channel time.

The envelope level data EL from the selector 36 and the loudness data LOUD read out from the envelope designation data memory 31 are input to a multiplier 39, whereby the envelope level data EL is converted to a value corresponding to the loudness data LOUD, i.e., a value corresponding to the preset volume data group and initial touch data IT, which is sent to the multiplier 15 mentioned above for multiplication by the tone waveform data.

The envelope data EL written in the envelope level memory 32 is output to the adder 35, where the speed data SPD is added there to, and then is output to an operational circuit 40. To the operational circuit 40 is input the up/down data U/P read out from the envelope data memory 31, in addition to the envelope level data EL.

The operational circuit 40 modifies the envelope level data EL according to the up/down data U/D, and this modification is effected by using an adder or the like, on the basis of the equation $$EL+U/D=MEL. \quad (1)$$

The envelope data EL can take values of "0" to "255"; "0" being taken when the up/down data U/D is "0" and 255 being taken when the up/down data U/D is 225. The large value of 225 is provided when the up/down data U/D is "1", so that channels assigned to tones, the envelope waveform thereof being in the attack phase, are not readily vacated to new "key on" event tones. The up/down data U/D is usually "1" when the envelope waveform is in the attack phase. The data EL. WP and U/P may have other values than those given in the above operation.

Further, the above equation (1) may be replaced with an equation $$EL\times U/D=MEL \quad (2)$$

The above modes of operation are by no means limited, in that a modification can be effected such that the envelope level data EL assumes a large value when the up/down data U/D is "1".

The modified envelope level data MEL thus obtained in the operational circuit 40 is written to the modified envelope level memory 33 by the CPU 5. The write channel memory areas of the modified envelope level memory 33 are the same as the read channel memory areas of the envelope level memory 32, and the writing and reading are synchronized by the timing control circuit 51 as shown in FIG. 9.

Figure 9:
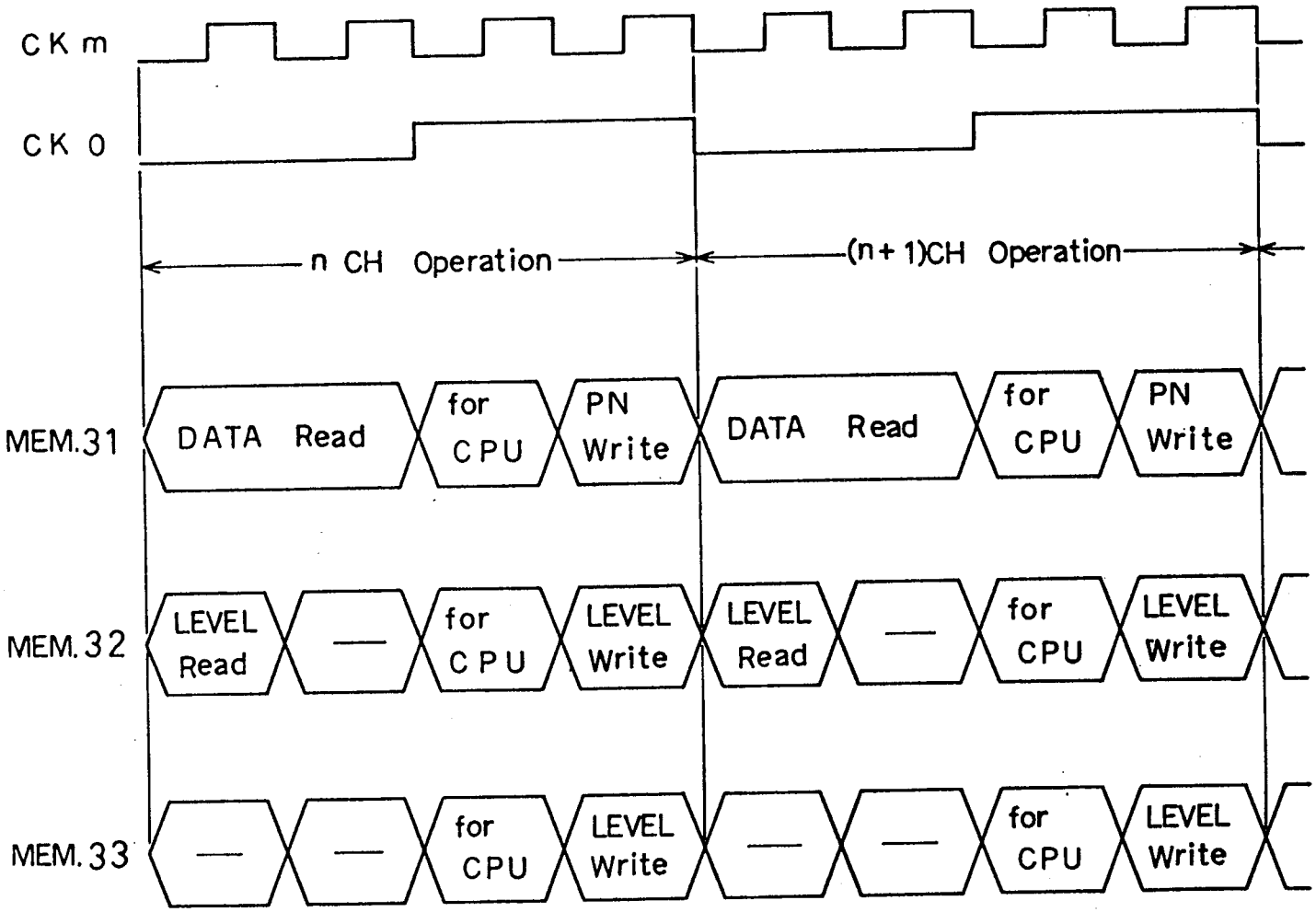
FIG. 9 is a time chart showing signal waveforms generated in various parts shown in FIG. 1.

As shown in FIG. 9, the share time of one channel is divided into four equal divisions, i.e., first to fourth time divisions, and when accessing the memories 31 to 33, the reading of data from the envelope designation data memory 31 is effected in the first and second time divisions, the writing of updated phase number data PN in the memory 31 is effected in the fourth time division, and the accessing to the memory 31 from the CPU is effected in the third time division.

The reading of data from the envelope level memory 32 is effected in the first time division, the writing of data in the envelope level memory 32 and in the modified envelope level memory 33 is effected in the fourth time division, and the access to the envelope and modified envelope level memories 32 and 33 from the CPU 5 is effected in the third time division. No work is done in other time divisions.

The switching of such time divisions is effected according to clock signals and other data sent from the timing control circuit 51 via the selector 52. Access data from the CPU 5 are also sent via the selector 52, and the selector 52 effects a switching according to clock data from the timing control circuit 51.

If during one channel share time the phase incrementor 38 changes the phase number data PN from "0" attack to "1" (decay and release), and further, the CPU 5 changes the phase number data PN to 2 (release), the change to "1" (decay and sustain) is made preferentially to the change to "2" (release), and to avoid this, the write protect circuit 45 and weight protect data wp are provided.

When the write protect data wp is "1", it is possible to write the phase number data PN in the envelope designation data memory 31, but when the write protect data wp is changed to "0" by the CPU 5, the above writing is inhibited. The write protect data wp is sent to the write protect circuit 45 to gate control a command signal for writing data in the envelope designation data memory 31 and the phase number data PN from the phase incrementor 38.

The modified envelope level data MEL output from the operational circuit 40 is sent to first, second and third minimum level detectors 41 to 43. The first minimum level detector 41 compares each modified envelope data MEL from the operational circuit 40 for all channels, and thus detects the number of the channel assigned to a tone of which the modified envelope level data MEL is minimum, and the number is output to the modified envelope level memory 33.

Similarly, the second and third minimum level detectors 42 and 43 compare modified envelope level data MEL for all channels, to detect the respective numbers of channels assigned to tones having the modified envelope level data MEL which are the next two smallest, and these three channel numbers are sent and written to the modified envelope level memory 33.

Thus, the numbers of channels assigned to tones of which the modified envelope level data MEL is smaller are detected for assignment to new "key on" tones. The processing in the minimum level detectors 41 to 43 may be executed not on the modified envelope level data from the operational circuit 40 but on the envelope level data EL from the envelope level memory 32.

8. Minimum level detectors 41 to 43

Figure 10:
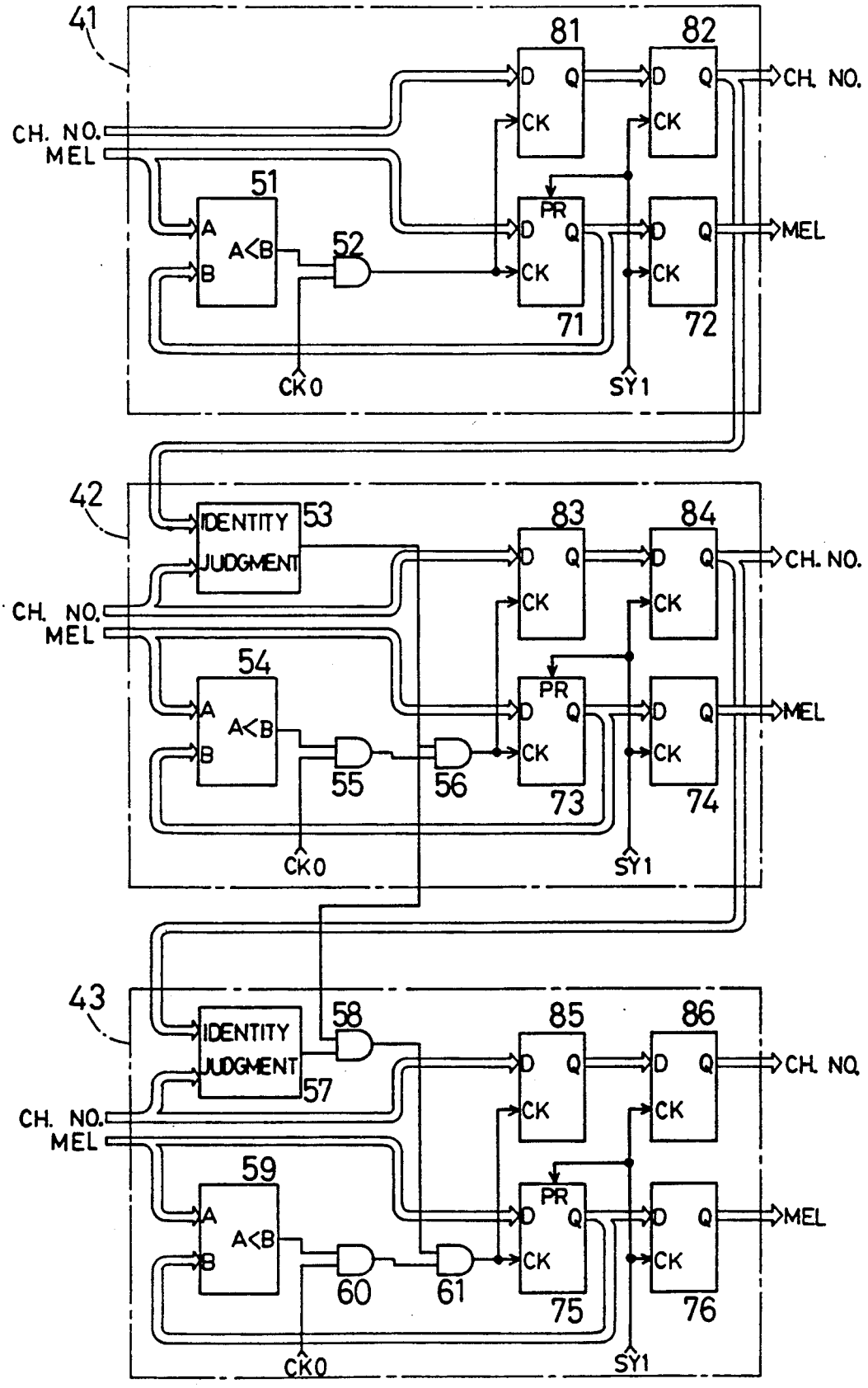
FIG. 10 is a view showing minimum level detection circuits 41 to 44.

FIG. 10 shows the first to third minimum level detectors 41 to 43. The modified envelope level data MEL from the operational circuit 40 is sent to a comparator 51 in the first minimum level detector 41. The comparator 51 is also supplied with the minimum modified envelope level data MEL detected and stored in a first level latch 71. If the minimum modified envelope level data MEL is smaller than the new modified envelope level data MEL, the comparator 51 outputs a detection signal, which is sent as a latch signal via an AND gate 52 to the first level latch 71, and thus the new modified envelope level data MEL is set.

The latch signal is also sent to a first channel number latch 81 for setting the channel number corresponding to the now modified envelope level data MEL. This channel number corresponds to address data provided by the CPU 5 to the envelope designation data, envelope level, and modified envelope level memories 31 to 33. When the share times for 16 channels have elapsed, the number of a channel for tone data of the minimum modified envelope level data MEL, among the 16 channel tones, is set in the first channel number latch 81, and the value of this minimum modified envelope level data MEL is set in the first level latch 71.

Figure 11:
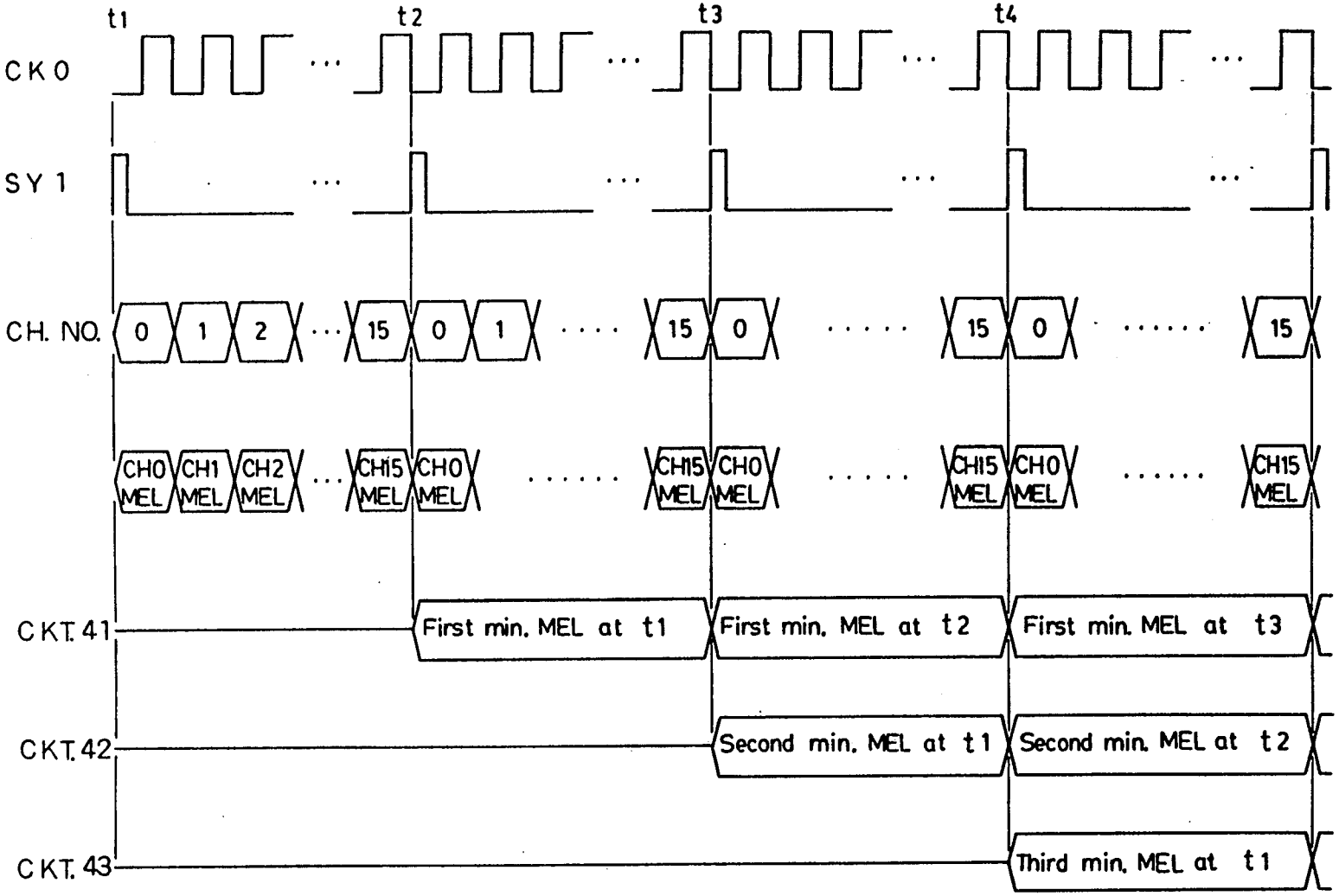
FIG. 11 is a time chart showing signal waveforms generated in various parts shown in FIG. 10.

A clock signal CKO is sent to the AND gate 52 as shown in FIG. 11. In the first half of the share time for one channel the comparator 51 effects a comparison, and in the latter half the data are set in the first channel number latch 81 and first level latch 71.

When the share times for 16 channels have elapsed, at the head of the next 16 channel share times a sharing signal SY1 is sent as a latch signal to the second level latch 72 and second channel number latch 82, as shown in FIG. 11. As a result, the minimum modified envelope level data MEL from the first level latch 71 is sent to the second level latch 72, and the channel number from the first channel number latch 81 is sent to the second channel number latch 82, this data being written in the modified envelope level memory 33.

The sharing signal SY1 is also sent to the first level latch 71, to reset latch data therein to the maximum value of "11 . . . 1". The latches 81, 82, 71 and 72 are of the R-S type.

The channel number data from the second channel number latch 82 in the first minimum level detector 41 is sent to an identity judgment circuit 53 in the second minimum level detector 41, and the same channel number as in the first channel number latch 81 in the first minimum level detector 41 is also sent to the identity judgment circuit 53. When the data are identical, the output signal of the identity judgment circuit 53 is set to a low level, to shut the AND gate 56, and thus the result ant signal from the comparator 54 of the second minimum level detector 42 is sent via the AND gate 56 to the first channel number latch 83 and first level latch 73.

Therefore, when the minimum modified envelope level data MEL and channel number detected by the first minimum level detector 41 are sent to the second minimum level detector 41, the setting of this data is inhibited, and as a result, the second minimum modified envelope level data MEL and channel number are detected in the second minimum level detector 41. The identity judgment circuit 53 consists of exclusive OR gates and an OR gate. The individual bits of the two channel number data are sent to the respective exclusive OR gates, and their identity determined, and if all the bits are not identical, a high level signal is output via the OR gate.

The construction and operation of the comparator 54, AND gate 55, first and second channel number latches 83 and 84, and first and second level latches 73 and 74 of the second minimum level detector 42 are the same as those of the comparator 51, AND gate 52, first and second channel number latches 81 and 82, and first and second level latches 71 and 72 of the first minimum level detector 41.

Also, the construction and operation of the comparator 59, AND gate 60, first and second channel number latches 85 and 86, first and second level latches 75 and 76, AND gate 61, and identity judgment circuit 57 of the third minimum level detector 43 are the same as those of the comparator 54, AND gate 55, first and second channel number latches 83, first and second level latches 73 and 74, AND gate 56 and identity judgment circuit 53 of the second minimum level detector 42.

The signals from the identity judgment circuits 53 and 57 of the second and third minimum level detectors 42 and 43 are sent to an AND gate 58, and the output signal of the AND gate 58 is sent as an open signal to the AND gate 61. The result signal from the comparator 50 of the third minimum level detector 43 is sent via the AND gate 61 to the first channel number latch 85 and first level latch 75.

Accordingly, when the minimum modified envelope level data MEL and channel numbers detected in the first and second minimum level detectors 41 and 42 are sent to the third minimum level detector 43, the setting of this data is inhibited, and as a result, the third minimum level detector 43 detects the third minimum modified envelope level data MEL and channel number. Similarly, it is possible to provide a fourth minimum level detector for detecting the fourth minimum modified envelope level data MEL and channel number, a fifth minimum level detector for detecting the fifth minimum modified envelope level data MEL and channel number, and so forth. The detected modified envelope level data MEL output from the second level latches 72, 74 and 76 may be stored together with channel numbers in $A0_H$ to $A2_H$ ($_H$ being a symbol representing the hexadecimal system) in the modified envelope level memory 33.

9. Overall process

Figure 12:
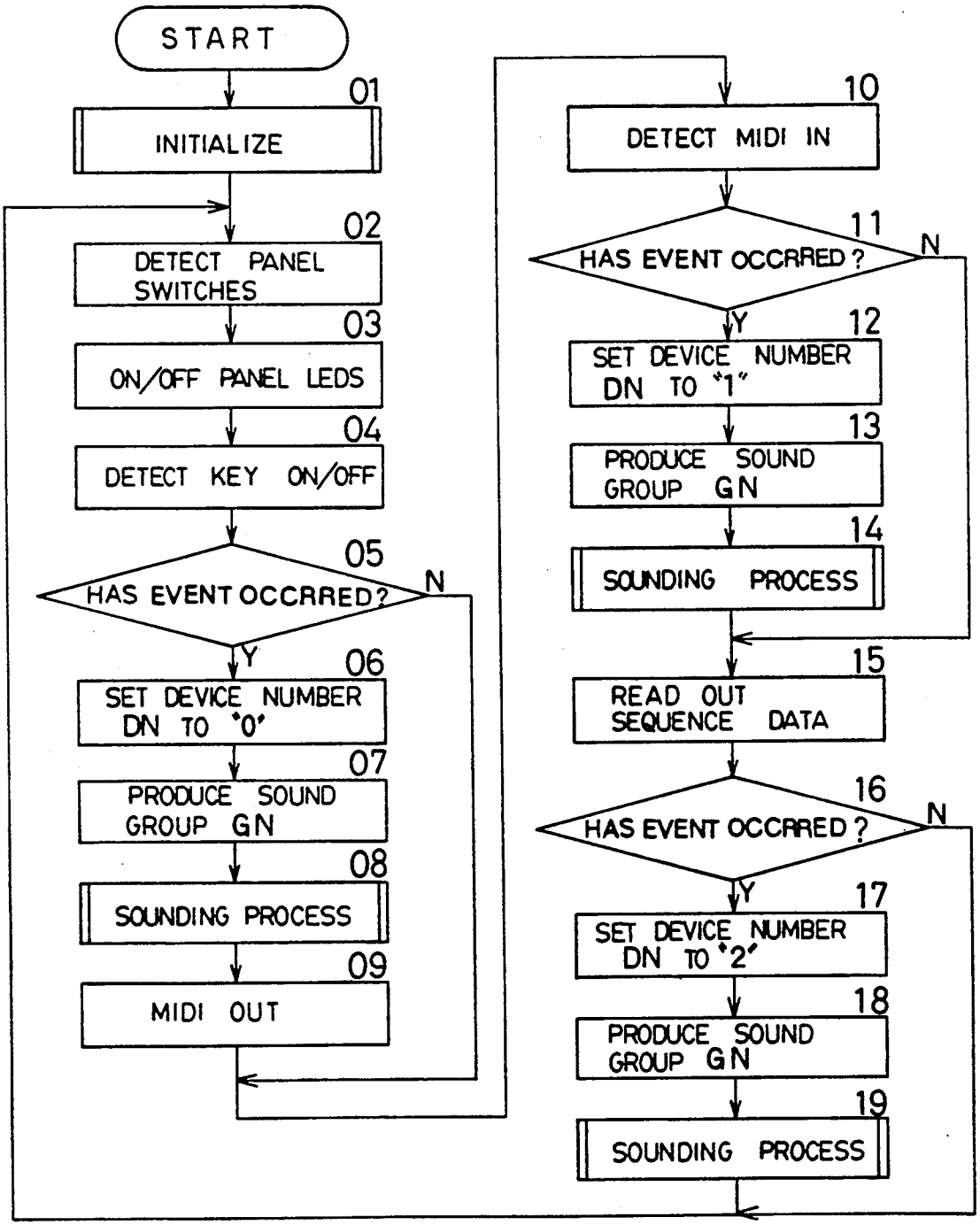
FIG. 12 is a flow chart showing an overall processing.

FIG. 12 shows a flow chart of the overall process. The process is started by connecting the system to the power supply. In this process, the CPU 5 first executes an initialize step (Step 01), a panel switch detection step (Step 02), and a panel LED on/off step (Step 03); and then executes a key routine in Step 04 and the following steps. The key routine includes three sub-routines, i.e., manual (Steps 04 to 09), MIDI (Steps 10 to 14), and sequencer (Steps 15 to 19).

In the key routine, the CPU 5 first detects the on/off state of the individual keys on the keyboard (Step 04), and if it detects a "key on" or "key off" event (Step 05), it sets the device number data DN to "0" (Step 06). This is done because the keyboard 1 is a manual device.

Then, the CPU 5 produces sound group number data GN corresponding to the event key (Step 07). The sound number group data GN is "0", "1", "2" and "3" if the event key belongs to the upper, the lower, the pedal, and the rhythm area, respectively, of the keyboard 1. Subsequently, the CPU 5 executes a sounding step for the event key (Step 08), and outputs tone data for the event key to the MIDI interface 9 (Step 09).

Then, the CPU 5 detects data input via the MIDI interface (Step 10). If the CPU 5 detects a "key on" or "key off" event (Step 11), it first sets the device number DN to "1", representing the MIDI device (Step 12), and then produces sound group number data GN from the MIDI channel data indicating a sound group, input simultaneously via the MIDI interface 9 (Step 13), and executes a sounding step according to the MIDI data (Step 14).

Then, the CPU 5 reads out sequence data from the ROM 7 (Step 15), and if it detects a "key on" or "key off" event (Step 16), sets the device number data DN to "2", representing the sequence device (Step 17). Then the CPU produces sound group number data GN from track number data indicating a sound group in the sequence data (Step 18), and executes a sounding step according to the sequence data (Step 19). The steps 15 to 19 are executed only when the autoplay mode is selected.

10. Sounding step

Figure 13:
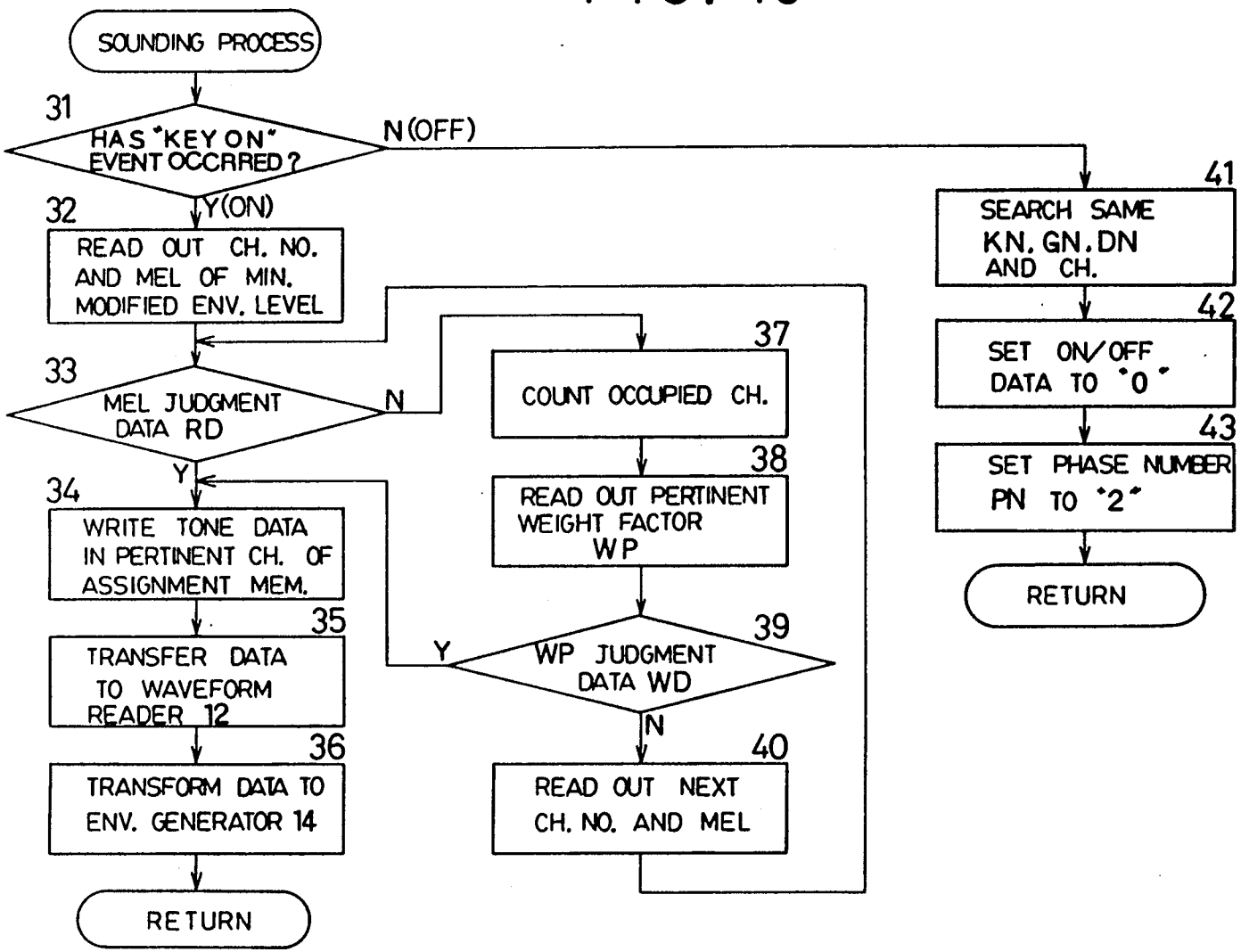
FIG. 13 is a flow chart showing a sounding process.

FIG. 13 shows the sounding step. This step occurs as the steps 08, 14 and 19 in the flow of FIG. 12. In this routine, the CPU 5 determines that the event mentioned above is a "key on" or "key off" event (Step 31). In the case of a "key on" event, the CPU 5 reads out channel number data for a tone of the minimum modified envelope level data MEL, stored in the address "$A0_H$" of the modified envelope level memory 33 in the envelope generator 14, and modified envelope level data MEL in the address of the modified envelope level memory 33 corresponding to the channel number data (Step 32), and checks whether the read-out modified envelope level data MEL is smaller than level judgment data RD (Step 33).

If the modified envelope level data MEL is smaller than the level judgment data RD, a channel is vacated unconditionally to the new "key on" tone. The value of the data RD is set as desired; for example, it may be set to the vacate level of the envelope waveform of a tone having a weak touch and in a low tone pitch group. This level judgment data RD is stored in the ROM 7 and read by the CPU 5.

If the modified envelope level data MEL is smaller than the level judgment data RD, the CPU 5 writes tone data for the "key off" event in a channel memory area in the assignment memory 10 corresponding to the channel number for the tone of the minimum modified envelope level data MEL (Step 34). Accordingly, the channel assigned to the tone having the minimum modified envelope level data MEL is reassigned to the new "key on" tone data, regardless of whether the pertinent key is being operated or of the waveform of the envelope.

In the case when a single "key on" event causes a sounding of a plurality of tones having different tone colors, as in the upper sound group, tone data corresponding to the individual tone colors is written. The tone data written in this way are on/off data "1" ("on"), key number data KN of the "on" key, sound group number data GN pertaining to the "on" key, device number data DN, initial touch data IT of the "on" key, and tone number data TN of the "on" key based on data stored in the tone number registers **26*a* to 26*h* in the working memory 25**.

Subsequently, the CPU 5 sends the key number data KN of the "on" key and tone number data TN, written in the assignment memory 10 in the step 34, to a memory in the waveform reader 12. The read waveform designation data (for example frequency number) may be stored in the ROM 7, to be read therefrom and output. Further, the CPU 5 writes envelope designation data corresponding to the tone number data TN and initial touch data IT written in the assignment memory 10, i.e., each envelope waveform phase speed data SPD, target data TGD, loudness data LOUD, phase number data PN of "0" (attack) and write protect data wp of "1" (ready to write) in the corresponding channel memory area of the envelope designation data memory 31 of the envelope generator 14 (Step 36). Then the CPU 5 returns to the step 02, 09 or 15 in the process.

As the speed data SPD and target data TGD of the envelope designation data, those corresponding to the tone number data TN and initial touch data IT are read from the ROM 7. Alternatively, as the data SPD and TGD to be stored in the ROM 7, only those corresponding to the tone number data TN may be modified, according to the magnitude of the initial touch data IT. The loudness data LOUD is calculated by multiplying the volume data group data VOL in the volume data group data register of the working memory 25, by the initial touch data IT.

If it is determined in step 33 that the read modified envelope level data MEL is greater than the level judgment data RD, the CPU 5 counts the number of occupied channels for each sound group (Step 37). This count is effected by clearing the occupied channel number registers **28*a* to 28*d* in the working RAM 25, and then reading sound group number data GN in each channel memory area of the assignment memory 10 and incrementing each of the occupied channel number registers 28***a* to 28*d*.

The CPU 5 then reads out weight factor data WP from the weight factor data table 20, according to the re-counted occupied channel number data UC and sound group number data GN written in the assignment memory 10, in step 34 (Step 38), and checks whether the weight factor data WP is smaller than the weight factor judgment data WD (Step 39).

If the weight factor data WD is smaller than the weight factor data WP, the channel is vacated to the new "key on" tone. The value of the data WD is set as desired, for example, to "0.89", indicating the borderline of an ideal channel assignment as marked by a circle in FIG. 7. When the weight factor judgment data WD is set to be greater than "0.89", the status of the channel assignment can easily be returned to the ideal channel assignment. When the weight factor judgment data WD is set to be smaller than "0.89", however, it is difficult to restore the ideal channel assignment. The weight factor judgment data WD is stored in the ROM 7, and read by the CPU 5.

If the weight factor data WP is smaller than the weight factor judgment data WD, the channel assignment in the steps 34 to 36 is executed even if the modified envelope level data MEL is greater than the level judgment data RD.

If the weight factor data WP is greater than the weight factor judgment data WD, the CPU 5 reads the channel number data for the tone of the second lowest modified envelope level data MEL stored in the next address "A1H" in the modified envelope level memory 33 in the envelope generator 14 (Step 40), and then returns to step 33 to check whether the modified envelope level data MEL is smaller than the level judgment data RD (Step 33).

Subsequently, the search for channels for tones with a small weight factor data WP in steps 37 to 40 is repeated, and channels for smaller weight factor data WP than the weight factor judgment data WD are selected from among three vacate candidate channels assigned to tones having a small modified envelope level data MEL. If such a channel is found, the channel assignment in steps 34 to 36 is executed.

Therefore, the greater the number of tones which are equivalent in the musical character, the smaller the weight factor data WP, thus permitting channels to be vacated in favor of new tones and leaving as many tones with a lower number of tones which are equivalent in the musical character as possible. Accordingly, it is thus possible to permit channels to be vacated which will not provide a substantial acoustic feeling of a departure from harmony, and will permit leaving as many tones giving an acoustic feeling of departure from harmony as possible.

The number of vacate candidate channels for tones with low modified envelope level data MEL is not limited to 3, as noted before in the description of the minimum level detectors 41 to 43.

If a "key off" event is determined in step 31, a search is made for channels in which the key number data KN, sound group number data GN and device number data DN in each channel memory area of the assignment memory 10 are identical to those of the tone data for the "key off" event (Step 41). The CPU 5 then sets the on/off data in this channel memory area to "0" ("off") (Step 42), sets the phase number data PN in the corresponding channel memory area in the envelope designation data memory 31 to "2" (release phase), sets the write protect data wp to "0" (write inhibit state) (Step 43), and then returns to the step 02, 09 or 15 of the process.

The weight factor data table 20 in FIG. 7 may store weight factor data WP corresponding to tone number data TN and occupied channel number data UC, or corresponding to the tone pitch group (or tone pitch) and occupied channel number data UC, or corresponding to the touch data group (initial touch or attach touch) and occupied channel number data UC, or corresponding to the device number data DN and occupied channel number data UC, or corresponding to the tone pitch group and occupied channel number data UC. Further, new weight factor data WP may be synthesized from these weight factor data WP by a multiplication or addition or other operation on the data.

In step 37, the CPU 5 correspondingly counts the occupied channel number data UC for each tone number, for each tone pitch group (or tone pitch), for each touch data, and for each device or for each volume data group. The device number data DN may be substituted by data indicating a melody, chord or rhythm performance.

11. Other examples

FIGS. 14 to 19 show flow charts of other examples of the sounding routine. These flow charts can replace the steps 37 and 38 in the flow chart of FIG. 13.

Figure 14:
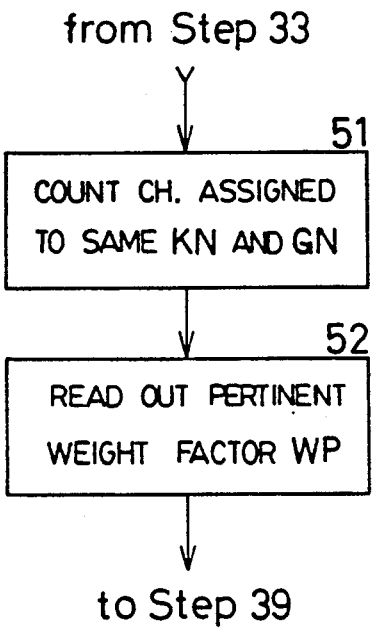
FIG. 14 is a flow chart showing a different example of a sounding process.

In FIG. 14, the CPU 5 searches channels in which the key number data KN and sound group number GN in each channel memory area in the assignment memory 10 are identical to those of the tone for the "key on" event, counts the assignment channel number (Step 51), and then reads weight factor data WP corresponding to the count number from the weight factor data table 20 in FIG. 8 (Step 52). Subsequently, the CPU 5 proceeds to the step 39 and executes the search of channels for small weight factor data WP in steps 37 to 40, and the channel assignment in steps 34 to 36.

The weight factor data table 20 in FIG. 8 may store weight factor data WP corresponding to only the number of channels assigned to the same key number, sound group, device, tone number, tone pitch group, touch data group or volume data group. Further, it is possible to produce new weight factor data WP through a synthesis such as multiplication or addition of the weight factor data WP.

Accordingly, in step 51 the CPU 5 counts occupied channel number data for the same key number, sound group, device, tone number, tone pitch group, touch data group or volume data group.

Figure 15:
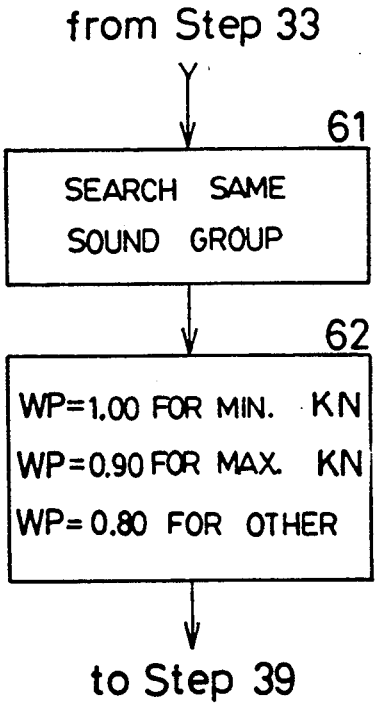
FIG. 15 is a flow chart showing a further example of sounding process.

In FIG. 15, the CPU 5 searches channel memory areas in the assignment memory 10 in which the same sound group number data GN as that for the "Key off" event are stored (Step 61), and then sets weight factor data WP for a channel having the smallest key number data KN to "1.00", sets weight factor data WP for the channel having the greatest key number data KN to "0.90", and sets other weight factor data WP to "0.80" (Step 62). The flow then proceeds to step 39 and a search of channels with a small weight factor data WP is executed in steps 37 to 40 and a channel assignment is executed in steps 34 to 36.

Further, it is possible to set weight factor data WP for the second, third, and so forth minimum or maximum key number data KN. In this case, the weight factor data WP may be set on the basis of a judgment of the magnitude of the volume data group (or volume), tone number, tone pitch group (or octave data) or touch data group, instead of the judgment of the magnitude of the tone pitch as mentioned above.

Figure 16:
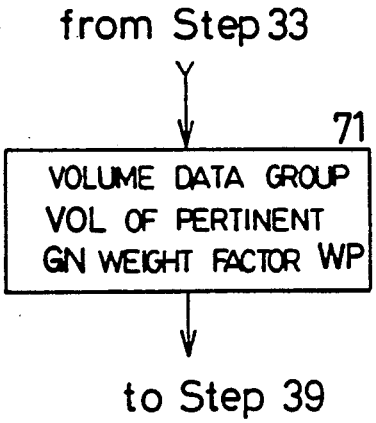
FIG. 16 is a flow chart showing a still further example of a sounding process.

In FIG. 16, the CPU 5 uses, as the weight factor data WP, the preset volume data group of the pertaining sound group to the "on" key, i.e., the volume data group data VOL stored in the pertaining one of the volume data group registers 26*a* to 26*h* in the working memory 25 (Step 71). Then, the CPU 5 proceeds to step 39 and executes a search of channels with a small weight factor data WP in steps 37 to 40, and a channel assignment in steps 34 to 36. In this case, the weight factor data WP may be determined according to the loudness data LOUD, instead of the volume data group data VOL.

Figure 17:
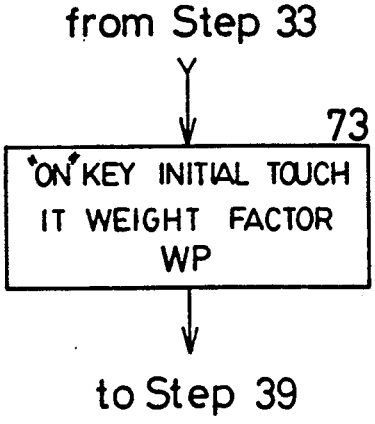
FIG. 17 is a flow chart showing yet another example of a sounding process.

In FIG. 17, the CPU 5 uses, as the weight factor data WP, the pertaining initial touch data to the "on" key, i.e., the pertaining initial touch data IT written in the assignment memory 10 in the step 34 (Step 73). Subsequently, the CPU 5 proceeds to step 39 and executes a search of channels with a small weight factor data WP in steps 37 to 40, and a channel assignment in steps 34 to 36.

Figure 18:
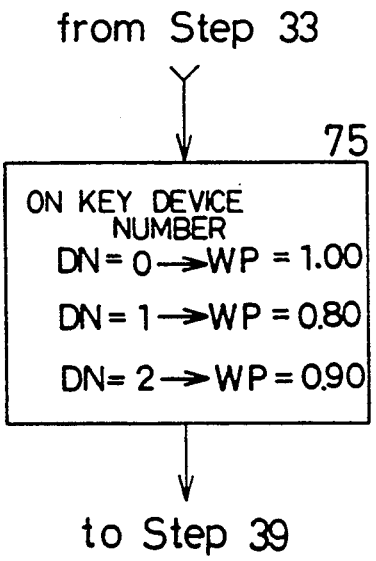
FIG. 18 is a flow chart showing another example of a sounding process.

In FIG. 18, the CPU 5 sets the weight factor data WP to "1.00" if the device number data DN pertaining to "on" is "0", representing a manual device, to "0.80" if the data DN is "1", representing a MIDI device, and to "0.90" if the data DN is "2", representing a sequence device (Step 75). Then, the CPU 5 proceeds to step 39 and executes a search of channels with a small weight factor data WP in steps 37 to 40, and a channel assignment in steps 34 to 36.

Figure 19:
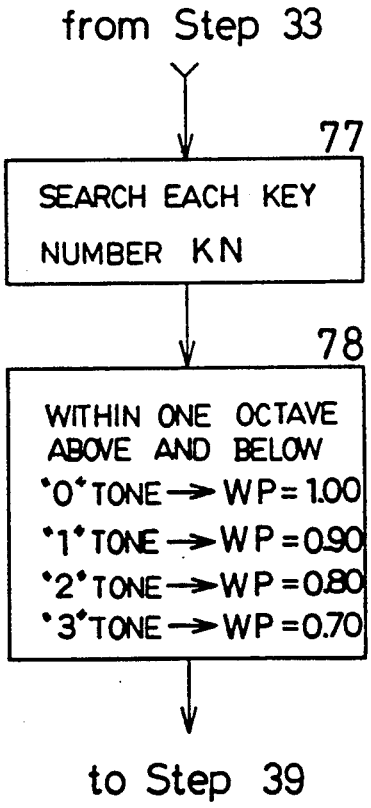
FIG. 19 is a flow chart showing a further example of a sounding process.

In FIG. 19, the CPU 5 searches key number data KN in each channel memory area of the assignment memory 10 (Step 77), and then sets the weight factor data WP to "1.00" if there is no data as each search key number data KN within one octave above and below the key number data KN pertaining to the "key on" event, to "0.90" if there is one data, to "0.80" if there are two data, and to "0.70" if there are three or more data (Step 78). Then the CPU 5 proceeds to step 39 and executes a search for channels with a low weight factor data WP in steps 37 to 40, and a channel assignment in steps 34 to 36.

The range of search for the search key number data KN is not limited to one octave above and below the key number data KN pertaining to the "key on" event. In this case, the weight factor data WP may be determined not on the basis of the relationship between the pitch of the tone for the "key on" event and the pitch of a tone with a channel already assigned thereto, but on the basis of the relationship between the volume data group of the tone for the "key on" event and the volume data group of a tone with a channel already assigned thereto, the relationship between the tone number TN of the tone for the "key on" event and the tone number TN of a tone with a channel already assigned thereto, the relationship between the tone pitch group (or octave data) of the tone for the "key on" event and the tone pitch group (octave data) of a tone with a channel already assigned thereto, or the relationship between the touch data group of the tone for the "key off" event and the touch data group of a tone with a channel already assigned thereto.

The weight factor data WP set in this way has a smaller value when the number of the same or similar tones is greater, thus permitting the vacating of channels to new tones and leaving as many tones with few equivalent in the musical character as possible. Therefore, it is possible to permit the vacating of channels to tones, which do not substantially give an acoustic feeling of a departure from harmony, and leave as many tones which do give an acoustic feeling of a departure from harmony, and thus it is possible to obtain channel assignment free from an acoustic feeling of departure from harmony.

Each weight factor data WP set in the process shown in FIGS. 13 to 19 may be set after processing same, for example adding or multiplying a certain constant to or by same. It is also possible to set new weight factor data WP obtained by processing, for example, adding or multiplying together the weight factor data WP set in the process of FIGS. 13 to 19.

The above embodiment of the invention is by no means limitative, and various changes and modifications are possible without departing from the scope of the invention. For example, instead of modified envelope level data MEL from the operational circuit 40, it is possible to supply envelope level data EL read from the envelope level memory 32 or data obtained by multiplying envelope level data EL from the multiplier 39 by loudness data LOUD, to the first to third minimum level detectors 41 to 43.

Further, instead of envelope level data EL from the envelope level memory 32, it is possible to send data obtained by multiplying envelope level data EL from the multiplier 39 by loudness data LOUD, to the operational circuit 40.

Further, instead of storing weight factor data WP in the weight factor data table 20, equations for calculating the values shown in the weight factor data table 20 shown in FIGS. 7 and 8 from occupied channel number data, etc. may be used for calculations in a programmed calculation step. Further, the weight factor data WP is not limited to the values of "0.00" to "1.00" but may take any desired values.

Moreover, the electronic musical instrument shown in FIG. 2 may not be provided with the keyboard 1 but may produce sounds according to only data output from an externally connected keyboard via the MIDI interface 9.

The scope of the present invention, therefore, is to be determined by the appended claims.

I claim:

1. A channel assigning system for an electronic musical instrument comprising:

musical tone generation channels corresponding in number to a maximum number of musical tones capable of being sounded simultaneously;

channel assigning means for assigning said musical tone generation channels to input musical tones;

musical character detecting means for detecting a musical character of the input musical tones which are assigned to said musical tone generation channels by said channel assigning means;

weight factor data generating means for generating weight factor data lowering a preferential degree of channel assignment for each of the input musical tones, according to a number of channel equivalents in the musical character of the input musical tones detected by said musical character detecting means; and channel assignment control means for selecting a channel of said musical tone generation channels, according to the weight factor data generated by said weight factor data generating means and assigning a newly input musical tone to said selected channel.

2. A channel assigning system for an electronic musical instrument comprising:

musical tone generation channels corresponding in number to a maximum number of musical tones capable of being sounded simultaneously;

channel assigning means for assigning said musical tone generation channels to input musical tones;

musical character detecting means for detecting a musical character of the input musical tones which are assigned to said musical tone generation channels by said channel assigning means;

equivalent number detecting means for detecting a number of musical tones which are equivalent in the musical character detected by said musical character detecting means;

weight factor data generating means for generating weight factor data indicating a preferential degree of channel assignment for each of the input musical tones, according to a number of channels of the input musical tones which are equivalent in the musical character as detected by said equivalent number detecting means; and channel assignment control means for selecting a channel of said musical tone generating channels according to the weight factor data generated by said weight factor data generating means and assigning a newly input musical tone to said selected channel.

3. The channel assigning system for an electronic musical instrument according to claims 1 or 2, wherein said channel assignment control means selects the channel with a low envelope level and assigns the newly input musical tone, within said musical tone generation channels corresponding to a musical tone having an envelope level lower than a particular level, regardless of the weight factor data.

4. The channel assigning system for an electronic musical instrument according to claim 2, wherein said equivalent number detecting means does not detect musical tone generation channels assigned to musical tones having envelopes in an attack state.

5. The channel assigning system for an electronic musical instrument claim 1 or claim 2, wherein said channel assignment control means searches channels assigned by said channel assigning means to musical tones with a lowered envelope level, selects a channel from said searched channels according to weight factor data generated by said weight factor data generating means, and assigned a newly input musical tone to said selected channel.

6. The channel assigning system for an electronic musical instrument according to claim 5, wherein said channel assignment control means assigns the newly input musical tone to the searched channel corresponding to a musical tone having an envelope level lower than a particular level, regardless of said weight factor data.

7. The channel assigning system for an electronic musical instrument according to claim 5, wherein said weight factor data is generated according to at least one of a volume, a sound group, a group of volume data, a musical tone generation source, a tone color, a tone pitch, a group of pitch data, a touch, and a group of touch data.

8. The channel assigning system for an electronic musical instrument according to claim 5, wherein said weight factor data is generated according to a number of channels assigned to one of a group of volume data, a sound group, a musical tone generation source, a tone color, a group of pitch data, and a group of touch data.

9. The channel assigning system for an electronic musical instrument according to claim 5, wherein said weight factor data is equal to one of a volume data, a volume range data, a data indicating a sound group, a data indicating a musical tone generation source, a tone color data, a tone pitch data, a tone range data, a touch data, and a touch range data.

10. The channel assigning system for an electronic musical instrument according to claim 5, wherein said weight factor data is generated according to at least one of a volume data relationship, a volume data group relationship, a sound group relationship, a musical tone generation source relationship, a tone color relationship, a pitch data relationship, a pitch data group relationship, a touch data relationship, and a touch data group relationship among musical tones having assigned channels.

11. The channel assigning system for an electronic musical instrument according to claim 5, wherein said weight factor data is generated according to at least one of a volume data relationship, a volume data group relationship, a tone color relationship, a pitch data relationship, a pitch data group relationship, a touch data relationship and a touch data group relationship between musical tones having channels to be assigned thereto and musical tones having assigned channels.

12. The channel assigning system for an electronic musical instrument according to claim 5, wherein said channel assignment control means does not search musical tone generating channels assigned to musical tones having envelopes in an attack state.

13. A channel assigning system for an electronic musical instrument comprising:

musical tone generation channels corresponding in number to a maximum number of musical tones capable of being sounded simultaneously;

channel assigning means for assigning said musical tone generation channels to input musical tones;

searching means for searching channels assigned by said channel assigning means to which have been assigned musical tones with low envelope levels;

equivalent number detecting means for detecting a number of musical tones which are equivalent in envelope level as detected by said searching means;

weight factor data generating means for generating weight factor data indicating a preferential degree of channel assignment for each of the input musical tones, according to a number of channels which are equivalent in envelope level as detected by said equivalent number detecting means;

channel assignment control means for selecting a channel from the channels searched by said searching means, according to the weight factor data generated by said weight factor data generating means and assigning a newly input musical tone to said selected channel.

14. The channel assigning system for an electronic musical instrument according to claim 13, wherein said channel assignment control means assigns the newly input musical tone to the channel searched by said searching means and corresponding to a musical tone having an envelope level lower than a particular level, regardless of said weight factor data.

15. The channel assigning system for an electronic musical instrument according to one of claims 1, 2 and 13, wherein said weight factor data is generated according to at least one of a volume, a sound group, a group of volume data, a musical tone generation source, a tone color, a tone pitch, a group of pitch data, a touch, and a group of touch data.

16. The channel assigning system for an electronic musical instrument according to one of claims 1, 2 and 13 wherein said weight factor data is generated according to a number of channels assigned to one of a group of volume data, a musical tone generation source, a tone color, a group of pitch data, and a group of touch data.

17. The channel assigning system for an electronic musical instrument according to one of claims 1, 2 and 13 wherein said weight factor data is equal to one of a volume data, a data indicating a sound group, a volume range data, a data indicating a musical tone generation source, a tone color data, a tone pitch data, a tone range data, a touch data, and a touch range data.

18. The channel assigning system for an electronic musical instrument according to one of claims 1, 2 and 13, wherein said weight factor data is generated according to at least one of a volume data relationship, a sound group relationship, a volume data group relationship, a musical tone generation source relationship, a tone color relationship, a pitch data relationship, a pitch data group relationship, a touch data relationship, and a touch data group relationship among musical tones having assigned channels.

19. The channel assigning system for an electronic musical instrument according to one of claims 1, 2 and 13, wherein said weight factor data is generated according to at least one of a volume data relationship, a volume data group relationship, a musical tone generation source relationship, a tone color relationship, a pitch data relationship, a pitch data group relationship, a touch data relationship and a touch data group relationship between musical tones having channels to be assigned thereto and musical tones having assigned channels.

20. The channel assigning system for an electronic musical instrument according to claim 13, wherein said searching means does not search musical tone generation channels assigned to musical tones having envelopes in an attack state.

21. The channel assigning system for an electronic musical instrument according to claim 13, wherein said search does not cover channels assigned to musical tones having envelopes in an attack state.

22. A channel assigning method for an electronic musical instrument comprising the steps of:

(A) assigning musical tone generation channels, a number of which correspond to a maximum number of musical tones capable of being sounded simultaneously, to input musical tones;

(B) detecting a musical character of the input musical tones which are assigned to said musical tone generation channels in said step (A);

(C) detecting a number of the input musical tones which are equivalent in musical character;

(D) generating weight factor data indicating a preferential degree of channel assignment for each of the input musical tones, according to a number of the musical tones which are equivalent in musical character; and (E) selecting at least one of the musical tone generation channels according to the weight factor data generated in said step (D) and assigning a newly input musical tone to said selected channel.

23. The channel assigning method for an electronic musical instrument according to claim 22, wherein said step (E) said at least one of the selected channels are assigned to at least one of the input musical tones with a low envelope level and said at least one of the selected channels are searched and the searched channels are assigned a newly input musical tone, said searched channel corresponding to a musical tone having an envelope level lower than a particular level, regardless of the weight factor data.

24. The channel assigning method for an electronic musical instrument according to claim 22, wherein said weight factor data generated in said step (D) is generated according to at least one of a volume, a sound group, a group of volume data, a musical tone generation source, a tone color, a tone pitch, a group of pitch data, a touch, and a group of touch data.

25. The channel assigning method for an electronic musical instrument according to claim 22, wherein said weight factor data generated in said step (D) is generated according to the number of channels assigned to one of a group of volume data, a sound group, a musical tone generation source, a tone color, a group of pitch data, and a group of touch data.

26. The channel assigning method for an electronic musical instrument according to claim 22, wherein said weight factor data generated in said step (D) is equal to one of a volume data, a volume range data, data indicating a sound group, a data indicating a musical tone generation source, a tone color data, a tone pitch data, a tone range data, a touch data, and a touch range data.

27. The channel assigning method for an electronic musical instrument according to claim 22, wherein said weight factor data generated in said step (D) is generated according to at least one of a volume data relationship, a volume data group relationship, a sound group relationship, a musical tone generation source relationship, a tone color relationship, a pitch data relationship, a pitch data group relationship, a touch data relationship, and a touch data group relationship among musical tones having assigned channels.

28. The channel assigning method for an electronic musical instrument according to claim 22, wherein said weight factor data generated in said step (D) is generated according to at least one of a volume data relationship, a volume data group relationship, a sound group relationship, a musical tone generation source relationship, a tone color relationship, a pitch data relationship, a pitch data group relationship, a touch data relationship and a touch data group relationship between musical tones having channels to be assigned thereto and musical tones having assigned channels.

29. The channel assigning method for an electronic musical instrument according to claim 22, wherein said search does not include musical tone generation channels assigned to input musical tones having envelopes in an attack state.

* * * * *